US009437200B2

(12) United States Patent
Sorensen et al.

(10) Patent No.: US 9,437,200 B2
(45) **Date of Patent: *Sep. 6, 2016**

(54) NOISE SUPPRESSION

(71) Applicant: Skype, Dublin (IE)

(72) Inventors: Karsten Vandborg Sorensen, Stockholm (SE); Jon Anders Bergenheim, Uppsala (SE); Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 91 days.

This patent is subject to a terminal disclaimer.

(21) Appl. No.: 14/324,679

(22) Filed: Jul. 7, 2014

(65) Prior Publication Data

US 2014/0324420 A1 Oct. 30, 2014

Related U.S. Application Data

(63) Continuation of application No. 12/803,295, filed on Jun. 23, 2010, now Pat. No. 8,775,171.

(30) Foreign Application Priority Data

Nov. 10, 2009 (GB) ..... 0919672.6
Nov. 26, 2009 (GB) ..... 0920732.5

(51) Int. Cl.
*G10L 19/012* (2013.01)
*G10L 21/0208* (2013.01)

(52) U.S. Cl.
CPC ..... *G10L 19/012* (2013.01); *G10L 21/0208* (2013.01)

(58) Field of Classification Search
CPC ... G10L 21/0208; G10L 25/78; G10L 15/20; G10L 21/0232; G10L 19/005
See application file for complete search history.

(56) References Cited

U.S. PATENT DOCUMENTS 4,514,703 A * 4/1985 Maher ..... H03G 3/3005 330/134
4,672,669 A 6/1987 DesBlache et al.
5,550,924 A 8/1996 Helf et al.
5,727,072 A 3/1998 Raman
5,839,101 A 11/1998 Vahatalo et al.
5,848,163 A 12/1998 Gopalakrishnan et al.
5,930,372 A * 7/1999 Kuriyama ..... G06F 1/1626 381/71.14

(Continued)

FOREIGN PATENT DOCUMENTS

EP 1349149 10/2003
EP 1630792 3/2006

OTHER PUBLICATIONS

"Final Office Action", U.S. Appl. No. 12/803,295, Aug. 15, 2013, 21 pages.

(Continued)

*Primary Examiner* — Fariba Sirjani
(74) *Attorney, Agent, or Firm* — Tom Wong; Micky Minhas

(57) ABSTRACT

A method and computing system for suppressing noise in an audio signal, comprising: receiving the audio signal at signal processing means; determining that another signal is input to the signal processing means, the input signal resulting from an activity which generates noise in the audio signal; and selectively suppressing noise in the audio signal in dependence on the determination that the input signal is input to the signal processing means to thereby suppress the generated noise in the audio signal.

20 Claims, 3 Drawing Sheets

(56) References Cited

U.S. PATENT DOCUMENTS 6,044,341 A 3/2000 Takahashi
6,044,342 A 3/2000 Sato et al.
6,122,331 A * 9/2000 Dumas ..... H03G 3/3089 375/345
6,122,384 A 9/2000 Mauro
6,324,499 B1 11/2001 Lewis et al.
6,374,213 B2 4/2002 Imai et al.
6,393,396 B1 5/2002 Nakagawa et al.
6,453,285 B1 9/2002 Anderson et al.
6,490,554 B2 12/2002 Endo et al.
6,519,559 B1 2/2003 Sirivara
6,768,979 B1 7/2004 Menendez-Pidal et al.
6,865,162 B1 3/2005 Clemm
6,935,797 B2 8/2005 Sim
7,236,929 B2 6/2007 Hodges
7,346,502 B2 3/2008 Gao et al.
7,454,010 B1 11/2008 Ebenezer
7,454,331 B2 11/2008 Vinton et al.
7,457,404 B1 * 11/2008 Hession ..... G10L 15/26 379/265.07
7,519,186 B2 4/2009 Varma et al.
7,536,303 B2 5/2009 Yoshizawa et al.
7,567,900 B2 7/2009 Suzuki et al.
7,693,293 B2 4/2010 Nemoto et al.
7,739,431 B2 6/2010 Lyness
8,019,089 B2 9/2011 Seltzer et al.
8,041,026 B1 10/2011 Coughlan et al.
8,069,039 B2 11/2011 Yoshioka
8,204,241 B2 6/2012 Asada et al.
8,213,635 B2 7/2012 Li et al.
8,244,528 B2 * 8/2012 Niemisto ..... G10L 25/78 704/208
8,249,275 B1 8/2012 Tsang et al.
8,265,292 B2 9/2012 Leichter
8,271,279 B2 9/2012 Hetherington et al.
8,473,282 B2 * 6/2013 Yoshioka ..... G10L 25/93 704/206
8,775,171 B2 7/2014 Sorensen et al.
2003/0187640 A1 * 10/2003 Otani ..... G10L 21/0208 704/233
2004/0078199 A1 4/2004 Kremer et al.
2004/0243405 A1 12/2004 Casparian et al.
2004/0249650 A1 * 12/2004 Freedman ..... G06Q 30/02 705/7.29
2005/0171769 A1 8/2005 Naka et al.
2006/0050895 A1 * 3/2006 Nemoto ..... G10L 21/0208 381/94.5
2006/0167995 A1 * 7/2006 Rui ..... H04N 7/147 709/204
2008/0118082 A1 5/2008 Seltzer et al.
2008/0201137 A1 8/2008 Vos et al.
2008/0279366 A1 11/2008 Lindbergh
2008/0306733 A1 12/2008 Ozawa
2009/0010453 A1 * 1/2009 Zurek ..... G10L 21/0208 381/94.5
2009/0086987 A1 4/2009 Wihardja et al.
2009/0264147 A1 * 10/2009 Kuroda ..... H04M 1/72519 455/550.1
2010/0027810 A1 * 2/2010 Marton ..... G10L 21/0208 381/94.1
2010/0088092 A1 4/2010 Bruhn
2010/0145689 A1 * 6/2010 Li ..... G10L 21/0208 704/210
2010/0198377 A1 * 8/2010 Seefeldt ..... H03G 3/3005 700/94
2011/0066429 A1 3/2011 Shperling et al.
2011/0102540 A1 * 5/2011 Goyal ..... H04N 7/147 348/14.08
2011/0112668 A1 * 5/2011 Sorensen ..... G10L 21/0208 700/94
2011/0112831 A1 5/2011 Sorensen et al.
2011/0137660 A1 6/2011 Strommer et al.
2012/0310641 A1 12/2012 Niemisto et al.

OTHER PUBLICATIONS

"First Action Interview Office Action", U.S. Appl. No. 12/803,295, Apr. 9, 2013, 3 pages.
"International Search Report and Written Opinion", Application No. PCT/EP2010/066947, Jan. 20, 2011, 9 pages.
"Notice of Allowance", U.S. Appl. No. 12/803,295, Feb. 27, 2014, 7 pages.
"Pre-Interview Communication", U.S. Appl. No. 12/803,295, Feb. 13, 2013, 3 pages.
"Search Report", Application No. GB0920732.5, Mar. 3, 2011, 1 page.
Subramanya, et al., "Automatic Removal of Types Keystrokes from Speech Signals", IEEE Signal Processing Letters, vol. 14, No. 5, May 7, 2007, pp. 363-366.
Foreign Office Action, GB Application No. 0920732.5, Mar. 29, 2016, 3 pages.

* cited by examiner

NOISE SUPPRESSION

RELATED APPLICATION

This application is a continuation of and claims priority under 35 U.S.C. §120 to U.S. patent application Ser. No. 12/803,295 filed on Jun. 23, 2010 and titled "Noise Suppression," which in turn claims priority to G.B. Patent Application Serial No. 0919672.6, filed on Nov. 10, 2009 and titled "Noise Suppression" and G.B. Patent Application Serial No. 0920732.5, filed on Nov. 26, 2009 and titled "Noise Suppression," the disclosures of which are incorporated by reference herein in their entirety.

BACKGROUND

When a user operates a computer, noises are often generated. For example, when a key on a computer keyboard is pressed there is a short mechanical sound (i.e. a clicking sound). Similarly, when the buttons on a mouse are pressed a clicking sound is produced.

A microphone of a computer can be used to receive audio signals, such as speech from a user. The user may enter into a call with another user, such as a private call (with just two users in the call) or a conference call (with more than two users in the call). The user's speech is received at the microphone and is then transmitted over a network to the other user(s) in the call. The audio signals received at the microphone will typically include speech components from the user and also noise from the surrounding environment. In order to improve the quality of the signal, such as for use in the call, it is desirable to suppress the noise in the signal relative to the speech components in the signal. When a user is operating a peripheral device of a computer at the same time as partaking in the call, the noise in the audio signal might include the noise generated by the user's operation of the peripheral device. For example, clicking noise such as the sound from a key stroke on a keyboard might be picked up by the microphone and included in the signal that is sent to the other participants in the call. The noise (e.g. clicking noise) can be annoying to the other participants in the call and can interfere with their experience of the call.

One approach for suppressing noise in an audio signal is to use background noise reduction methods. Background noise reduction methods analyse the audio signal in a time and/or frequency domain during periods of speech inactivity (i.e. when the user is not speaking). The background noise reduction methods identify signal components that reduce the perceived quality of speech and attenuate those identified components. Background noise algorithms which can be used in the background noise reduction methods are usually successful in removing stationary noise (e.g. noise comprising a periodic signal and its potential harmonics) from the audio signal. Stationary noise comprises noise components for which the statistical distribution functions do not vary over time. However, background noise algorithms have difficulty in identifying and attenuating transient and non-stationary components of noise, such as clicking noise generated for example from keyboard activity. Clicking noise is a good example of non-stationary noise in that clicking noise fluctuates in time, and any clicking noise generated by a user (such as by typing on a keyboard) is likely to be treated by the background noise algorithm as if it were a speech signal, and therefore would not be attenuated.

Another approach for suppressing noise from an audio signal is to use specific noise attenuation algorithms for respective specific types of noise, such as keyboard noise attenuation algorithms for attenuating keyboard noise. Keyboard noise attenuation algorithms typically analyse the audio signal received at a microphone to detect and filter out components of the audio signal that are identified as keyboard clicking noise. In this sense, keyboard noise attenuation algorithms comprise two major steps. The first step is detection of the clicking noise in the audio signal and the second step is attenuation of the clicking noise. The detection step can be problematic when the user is engaged in a call because some types of noise such as clicking noise (e.g. keyboard tapping noise) have similar initial characteristics to those of speech, in particular to those of the onset of speech. It is therefore difficult to detect these types of noise in a reliable way and to differentiate between speech and these types of noise without adding a delay and looking for a full click. In the second step of attenuating the noise it is preferred to remove only those components of the signal coming from the noise generating activity (e.g. the keystrokes on the keyboard} while not modifying other components in the audio signal. In particular it is preferable not to modify the speech components of the audio signal when attenuating the clicking noise from the audio signal. However, as described above it can be difficult to detect the difference between some types of noise (such as clicking noise} and the onset of speech, and therefore it is problematic to attenuate those types of noise without distorting the speech components of the audio signal. This problem is compounded by the fact that the onset of speech signals are crucial for the intelligibility of the speech, so any attenuation of the onset of speech can seriously affect the intelligibility of the speech in the audio signal.

Existing clicking noise attenuation algorithms can be split into two groups. The first group of clicking noise attenuation algorithms are effective in attenuating clicking noise from the audio signal without distorting the speech components of the audio signal to an extent that would be unacceptable to a user. However, the first group of clicking noise attenuation algorithms require data from the future audio signal, such that a delay somewhere around 100 ms is added which makes the use of the clicking noise attenuation algorithms of the first group impractical for use in real time communications, such as a voice call. Any delays added to the audio signal will have a detrimental effect on the user's perception of the quality of a call or other real time communication. The second group of clicking noise attenuation algorithms do not add a significant delay to the processing of the audio signal, such that clicking noise attenuation algorithms of the second group are suitable for use in real time communications, such as a voice call. However, the algorithms of the second group are not as effective at attenuating clicking noise from the audio signal as are the algorithms of the first group. The algorithms of the second group have a tendency to distort the speech components of the audio signal because they will occasionally mistake speech onsets for a click, such as a tap on the keyboard.

There is therefore a problem of reliably suppressing noise generated by user activities such as keyboard clicking from an audio signal for use in a real time communication event, without significantly distorting speech components in the audio signal.

SUMMARY

According to a first aspect of the invention there is provided a method of suppressing noise in an audio signal, the method comprising: receiving the audio signal at signal processing means; determining that another signal is input to the signal processing means, the input signal resulting from an activity which generates noise in the audio signal; and selectively suppressing noise in the audio signal in dependence on the determination that the input signal is input to the signal processing means to thereby suppress the generated noise in the audio signal.

According to a second aspect of the invention there is provided a computing system for suppressing noise in an audio signal, the computing system comprising: receiving means for receiving the audio signal; input means for generating an input signal; signal processing means for determining that the input signal is input from the input means, the input signal resulting from an activity which generates noise in the audio signal; and noise suppressing means for selectively suppressing noise in the audio signal in dependence on the determination that the input signal is input to the signal processing means to thereby suppress the generated noise in the audio signal.

Noise generated by a user operated device (such as the clicking noise generated by a keyboard or a mouse or other button clicking activity) is suppressed in an audio signal. The operating system of a computer can determine when noise generating activity is carried out on the device other than by detection in the audio signal (e.g. the operating system can determine when the keys of a keyboard are being pressed). The operating system can determine that the noise generating activity is being carried out, without knowing whether the generated noise is picked up by the microphone 120. For example, if a headset is used, the operating system may determine that keyboard activity is being carried out, but the keyboard noise might be too quiet to be picked up by the microphone 120 in the headset. A notification might be sent from the operating system only when it is determined that noise generating activity is present on the device. The notification can enable or disable techniques for the suppression of the generated noise in the audio signal received at the microphone. In some embodiments, an algorithm for suppressing clicking noise in the audio signal is activated when clicking activity is carried out on a peripheral device, but is deactivated when clicking activity is not carried out on the peripheral device.

An advantage of the invention is that the noise suppression methods are applied to the audio signal only when noise generating activity is carried out. This means that noise suppression algorithms which can operate in real time can be employed. For example, when no clicking activity is carried out, clicking noise suppression algorithms are not activated so speech components in the audio signal are not distorted by the clicking noise suppression algorithms. In fact no components of the audio signal are distorted by the clicking noise suppression algorithms when no clicking activity is carried out on a peripheral device.

Distortion of the speech components of the signal arising from misclassified clicking noise detection by a clicking noise suppression algorithm is limited to times at which clicking activity on a device is reported by the operating system. As described above, this can be achieved by only detecting and attenuating the noise generated by the device (such as keyboard noise) when there is noise generating activity on the device (such as keyboard activity) as reported by the operating system.

Advantageously, input signals from a device to the operating system are used to determine when noise generating activity is present at the device, rather than analysing the audio signal received at the microphone to determine components of the audio signals that are characteristic of the noise generated by the noise generating activity at the device. The input signals from the device are not audio signals. The input signals from the device could be electrical signals, but the input signals could also be transmitted over a wireless connection. A software driver associated with the input device typically detects the input signal and sends a message to the operating system to inform the operating system that the input signal has been detected.

BRIEF DESCRIPTION OF THE DRAWINGS

For a better understanding of the present invention and to show how the same may be put into effect, reference will now be made, by way of example, to the following drawings in which.

DETAILED DESCRIPTION

Figure 1:
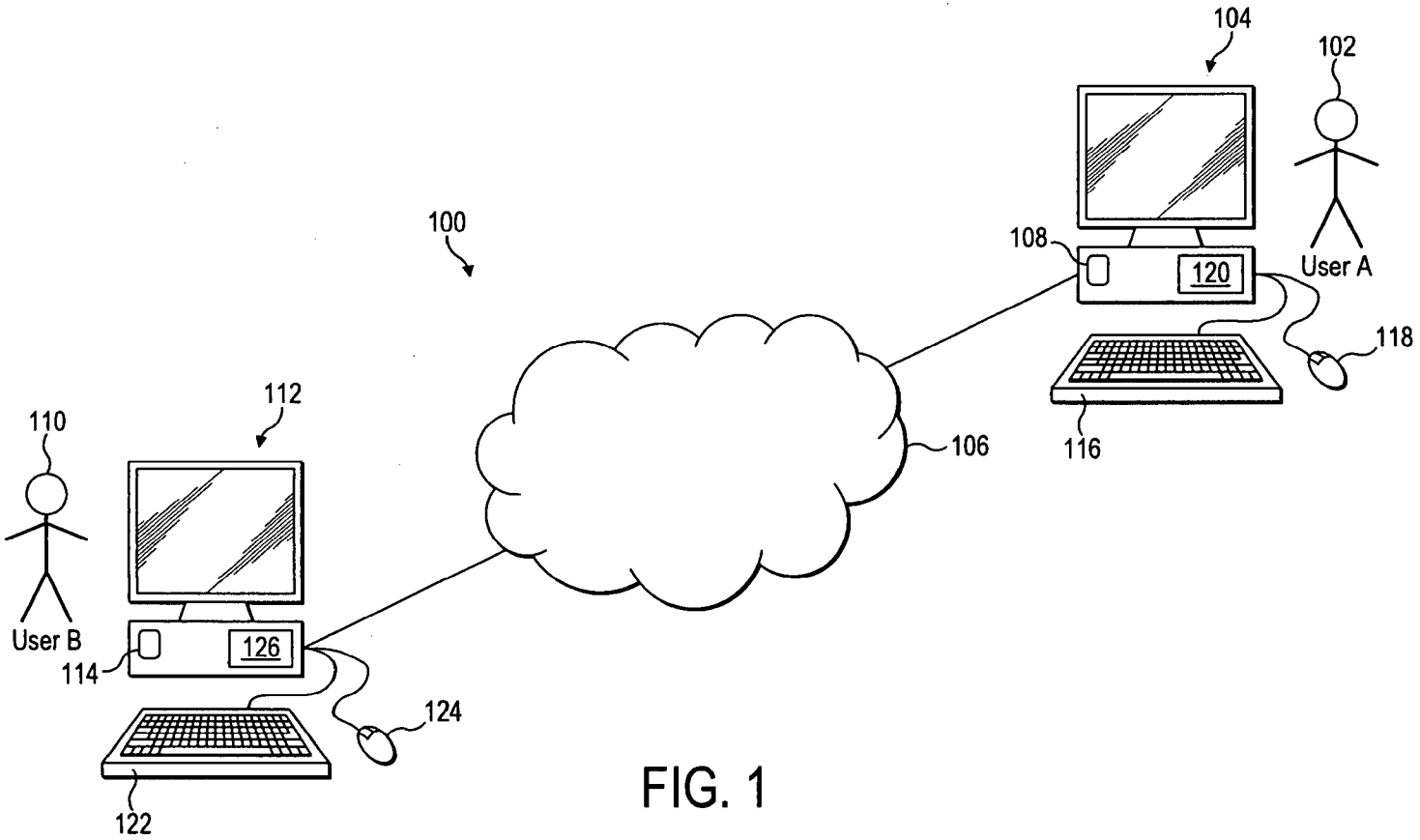
FIG. 1 shows a P2P network built on top of packet-based communication system.

Reference is first made to FIG. 1, which illustrates a communication system such as a packet-based P2P communication system. A first user of the communication system (User A 102) operates a user terminal 104, which is shown connected to a network 106. The communication system 100 utilizes a network such as the Internet. The user terminal 104 may be, for example, a personal computer ("PC") (including, for example, Windows™, Mac OS™ and Linux™ PCs), a mobile phone, a personal digital assistant ("PDA"), a gaming device or other embedded device able to connect to the network 106. The user device 104 is arranged to receive information from and output information to a user 102 of the device. The user terminal 104 comprises a microphone 120 for receiving audio signals. In a preferred embodiment the user device 104 comprises a display such as a screen and an input device such as a keyboard 116, mouse 118, keypad, joystick and/or touch-screen. The user device 104 is connected to the network 106.

The user terminal 104 is running a communication client 108, provided by the software provider. The communication client 108 is a software program executed on a local processor in the user terminal 104.

Figure 2:
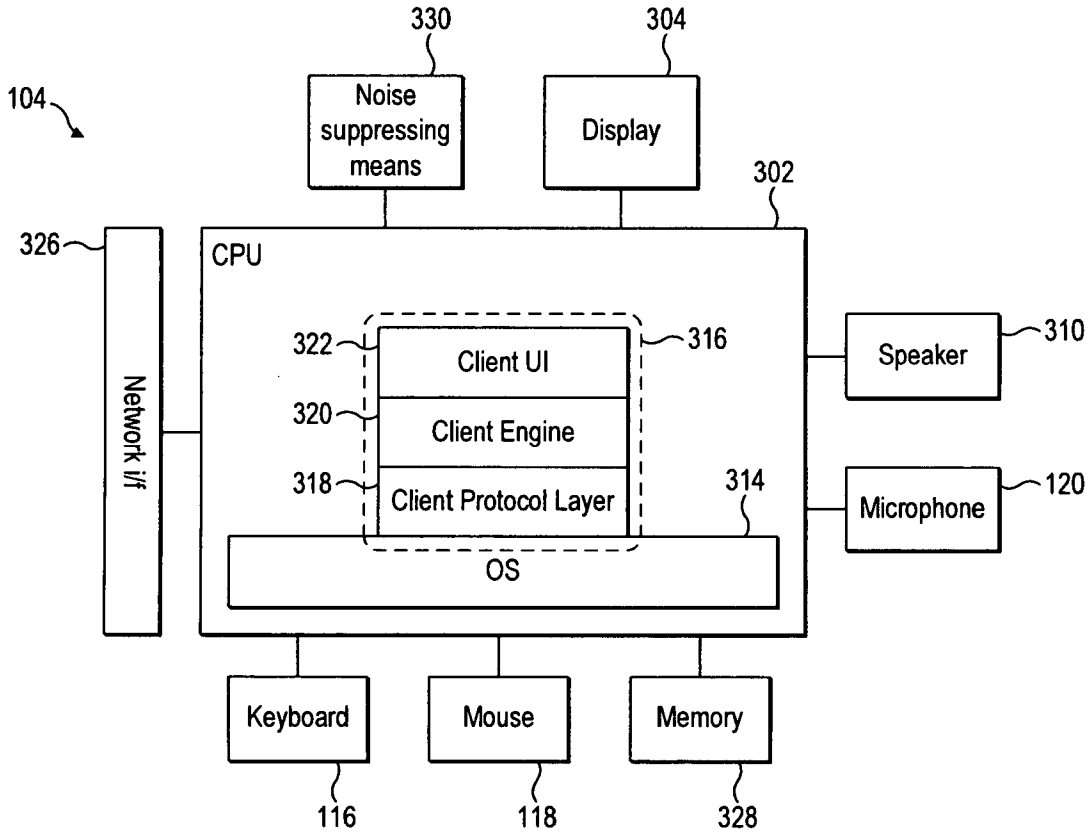
FIG. 2 shows a schematic view of a user terminal according to a preferred embodiment.

FIG. 2 illustrates a schematic view of the user terminal 104 on which is executed client 108. The user terminal 104 comprises a central processing unit ("CPU") 302, to which is connected a display 304 such as a screen, input devices such as keyboard 116 and a pointing device such as mouse 118. The display 304 may comprise a touch screen for inputting data to the CPU 302. An output audio device 310 (e.g. a speaker) and an input audio device such as microphone 120 are connected to the CPU 302. The display 304, keyboard 116, and mouse 118 are not integrated into the user terminal 104 in preferred embodiments and are connected to the CPU 302 via respective interfaces (such as a USB interface), but in alternative user terminals (such as laptops) the display 304, the keyboard 116, the mouse 118, the output audio device 310 and the microphone 120 may be integrated into the user terminal 104. The CPU 302 is connected to a network interface 326 such as a modem for communication with the network 106. The network interface 326 may be integrated into the user terminal 104 as shown in FIG. 2. In alternative user terminals the network interface 326 is not integrated into the user terminal 104.

FIG. 2 also illustrates an operating system ("OS") 314 executed on the CPU Running on top of the OS 314 is a software stack 316 for the client 108.

The software stack shows a client protocol layer 318, a client engine layer 320 and a client user interface layer ("UI") 322. Each layer is responsible for specific functions. Because each layer usually communicates with two other layers, they are regarded as being arranged in a stack as shown in FIG. 2. The operating system 314 manages the hardware resources of the computer and handles data being transmitted to and from the network via the network interface 326. The client protocol layer 318 of the client software communicates with the operating system 314 and manages the connections over the communication system. Processes requiring higher level processing are passed to the client engine layer 320. The client engine 320 also communicates with the client user interface layer 322. The client engine 320 may be arranged to control the client user interface layer 322 to present information to the user via a user interface of the client and to receive information from the user via the user interface.

The user terminal 104 also includes noise suppressing means 330 connected to the CPU 302. Although the noise suppressing means 330 is represented in FIG. 2 as a stand-alone hardware device, the noise suppressing means 330 could be implemented in software. For example the noise suppressing means could be included in the client 108 running on the operating system 314. As will be described in further detail below, the noise suppressing means 330 is used to suppress noise from an audio signal that is generated by activity on a user operated device, such as keyboard activity on the keyboard 116 or mouse activity on the mouse 118. The CPU 302 and any device drivers of the input means can be considered to be signal processing means of the user terminal 104.

Figure 3:
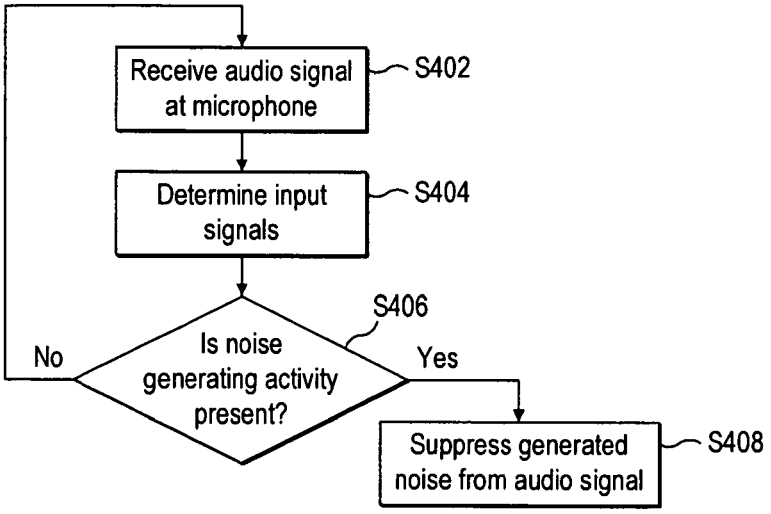
FIG. 3 is a flowchart of a process for suppressing noise in an audio signal according to a preferred embodiment.

With reference to FIG. 3 there is now described a process for suppressing noise in an audio signal according to a preferred embodiment. In step S402 an audio signal is received at the microphone 120 of the user terminal 104. The audio signal may include speech from User A and may be for use in a communication event, such as a call with User 8 over the network 106. The audio signal typically also includes noise, such as stationary background noise and non-stationary noise. It is often desirable to suppress (such as by attenuating or removing) the noise from the audio signal such that the quality of the speech in the audio signal is improved. This is particularly desirable where the audio signal is for use in a communication event, such as a call over the network 106 with User B.

In step S404 it is determined at the operating system 314 whether input signals have been input at a device (or input means) connected to the CPU such as the keyboard 116 or the mouse 118. The input signals are not audio signals. The input signals indicate data from the device, for example the input signals may represent key strokes on the keyboard 116. The input means which inputs the input signals to the CPU 302 is not the microphone 120, and does not receive audio signals. The input signals are typically caused by activity on an input means connected to the user terminal 104. Device drivers associated with the input device detect the generation of the input signal and inform the operating system of the input signal. For example keyboard activity on the keyboard 116 will produce input signals to the operating system 314 as the keys are pressed. When the keys on the keyboard 116 are pressed, audible clicking noise will be generated, and this clicking noise may contribute to the noise in the audio signal received at the microphone 120. Operating systems generally allow software to monitor activity on inputs, such as keyboard activity. One way to allow this is to look for events that are sent out by the operating system. Another way of detecting the input signals is with an Application Programming Interface (API) which allows the state of the input to be accessed, for example the state of each key of the keyboard 116 can be accessed through an API. By using such an API, the noise suppressing means 330 can be informed if a key is pressed.

In step S406 it is determined whether noise generating activity is present. In other words, it is determined whether any of the inputs detected in step S404 will generate noise that may be included in the audio signal received at the microphone.

If noise generating activity is determined to be present in step S406 then the method passes to step S408. The noise suppressing means 330 then acts to suppress the generated noise from the audio signal.

The suppression of the noise in step S408 can be implemented in more than one way. As a first example, the noise suppressing means 330 mutes the audio signal received at the microphone 120 for a predetermined time period $t_1$ (a muting time period) following the determination that noise generating activity is present in step S406. In this way, the generated noise is removed from the audio signal. However, all other components of the audio signal are also removed for the muting time period. This first example is therefore only practical where the muting time period is short and the frequency of noise generating activities is low, such that too much of the audio signal will not be removed. The muting time period $t_1$ has a duration that is characteristic of the duration of the noise generated by the noise generating activity. For example when the noise generating activity is a key stroke on keyboard 116, the muting time period $t_1$ has a duration that is characteristic of the duration of the clicking sound caused by a key stroke.

As a second example, the audio signal is analysed to detect speech components of the audio signal. The audio signal is not muted within a predetermined period of time $t_2$ (a speech time period) from the detection of speech components in the audio signal. However, if no speech components have been detected in the audio signal for a time period greater than the speech time period $t_2$ then the noise suppressing means 330 mutes the audio signal received at the microphone 120 for the muting time period $t_1$ following the determination that noise generating activity is present in step S406. In this way, when User A is speaking into the microphone 120, the audio signal will not be muted such that the speech components of the signal are not lost. During speech the audio signal is not muted even if a noise generating activity is present as determined in step S406. The speech time period is longer than the muting time period (i.e. $t_2>t_1$) so that when speech is detected and noise generating activity is present the audio signal is not muted. Furthermore, if the audio signal is muted due to the determination that noise generating activity is present in step S406, and during the muting time period speech is detected in the audio signal, then the audio signal is unmuted as soon as the speech is detected, i.e. before the expiry of the muting time period. In this way, the detection of speech on the audio signal overrides the muting of the audio signal due to the determination in step S406 of an input caused by a noise generating activity.

As a third example, when no noise generating activity is present (as determined in step S406) the noise suppressing means is disabled. In other words when no noise generating activity is detected the noise suppressing means 330 does not attempt to detect and/or remove, filter, subtract or attenuate the type of noise that would be generated by the noise generating activity from the audio signal. For example, when no keyboard activity is detected, the noise suppressing means 330 will not attempt to detect and suppress keyboard tapping noise from the audio signal. However, when noise generating activity is present (as determined in step S406) the noise suppressing means 330 is enabled (e.g. switched on). In other words when noise generating activity is detected the noise suppressing means 330 attempts to detect and remove, filter, subtract or attenuate the type of noise that would be generated by noise generating activity from the audio signal. For example, when keyboard activity is detected, the noise suppressing means 330 will attempt to detect and suppress keyboard tapping noise from the audio signal. In this way, the noise suppressing means 330 is only utilized when the noise generating activity is present, such that when the noise generating activity is not present the speech in the audio signal is not distorted at all by the noise suppressing means 330.

As a fourth example, the noise suppressing means 330 is enabled both when noise generating activity is present and when noise generating activity is not present. However, when noise generating activity is determined to be present, the parameters of the noise suppressing means 330 are changed such that the generated noise is suppressed to a greater extent than when noise generating activity is not determined to be present. For example, the method employed by the noise suppressing means 330 aiming to detect and/or remove, filter, subtract or attenuate keyboard noise from the audio signal is adjusted when an input is detected from the keyboard 116, since it is then more likely to detect keyboard noise in the audio signal. Similarly, when no keyboard activity is detected in step S404 the noise suppressing means is adjusted such that fewer components in the audio signal are determined to be keyboard noise. This means that fewer speech signals are erroneously determined to be keyboard noise, and therefore fewer speech signals are distorted by the noise suppressing means 330 when no keyboard activity is detected.

The noise suppressing means 330 uses a noise suppressing algorithm that is capable of suppressing noise in the audio signal in real time. In this way, the audio signals can be used in a real time communication event such as a call over the network 106. The method may also be applicable in other scenarios and is not limited to use in a call over the network 106. For example, the method is also suited for use in any other type of communication event in which audio signals are required to be transmitted in real time. The method is also suited for any use in which suppression is required of noise generated by an activity which causes an input to the user terminal.

There is therefore provided a method and system in which the operating system 314 of a user terminal 104 is used to inform the noise suppressing means 330 if there is a high likelihood for non-stationary noise generated by activity on an input to the user terminal 104. The noise suppressing means 330 can then take action to suppress the generated noise only when there is a high likelihood of it being in the audio signal received at the microphone 120. In this way, when no noise generating activity is detected using information provided by the operating system 314, the noise suppressing means 330 does not attempt to suppress the noise to as great an extent as when noise generating activity is detected. This means that speech in the audio signal will be less distorted when no noise generating activity is detected (as compared to when noise generating activity is detected). Advantageously, the input signals to the operating system are used to determine the presence of the noise generating activity rather than attempting to analyze the audio signal received at the microphone to determine the presence of components in the signal relating to the noise generating activity.

The signal processing means of the user terminal 104 is used to determine that the input signal is input from the input means. Another input to the signal processing means may be from a fan or hard disk of the user terminal 104 (not shown in the figures). When the fan is switched on it will generate noise which may be picked up by the microphone 120. Similarly, when the hard disk is operated it will generate noise which may be picked up by the microphone 120. The signal processing means can use input signals from the fan and the hard disk respectively to determine when the fan and/or the hard disk are in use. In some embodiments the signal processing means can use the input signal from the fan and/or hard disk in same way as an input signal from the keyboard 116 or the mouse 118. In this way, the noise suppressing means 330 can be applied based on the usage of the fan and/or hard disk.

While this invention has been particularly shown and described with reference to preferred embodiments, it will be understood to those skilled in the art that various changes in form and detail may be made without departing from the scope of the invention as defined by the appendant claims.

What is claimed is:

1. A method comprising:

identifying an input signal that results from an activity which generates noise in an audio signal; and suppressing the noise in the audio signal in response to said identifying, said suppressing including:

determining an elapsed time since a most recent detected speech component of the audio signal during which no speech components are detected in the audio signal; and muting the audio signal for a muting time period in response to determining that the elapsed time exceeds a pre-specified speech time period, the pre-specified speech time period being greater than the muting time period and corresponding to a period of time that is to be measured while no speech components are detected in the audio signal, the muting time period having a predetermined duration that is characteristic of a duration of the noise generated by the activity.

2. The method of claim 1, wherein the activity is a clicking activity and the generated noise is a clicking noise.

3. The method of claim 1, wherein said identifying comprises identifying the activity as at least one of a button clicking activity, a keyboard activity, or a mouse click activity.

4. The method of claim 1, wherein said identifying is performed by an operating system of a computing device.

5. The method of claim 1, further comprising receiving a notification of the input signal, and wherein said suppressing is performed in response to the notification.

6. The method of claim 1, wherein said suppressing further comprises:

analyzing the audio signal to detect components of the audio signal which have characteristics of the generated noise; and suppressing the detected components of the audio signal.

7. The method of claim 1, wherein the audio signal is generated as part of a real time communication event.

8. A computing system comprising:

a signal processor configured to perform operations including identifying an input signal that results from an activity which generates noise in an audio signal; and a noise suppressor configured to perform operations including suppressing the noise in the audio signal, said suppressing including:

determining an elapsed time since a most recent detected speech component of the audio signal during which no speech components are detected in the audio signal; and muting the audio signal for a muting time period in response to determining that the elapsed time exceeds a pre-specified speech time period, the pre-specified speech time period being greater than the muting time period and corresponding to a period of time that is to be measured while no speech components are detected in the audio signal, the muting time period having a predetermined duration that is characteristic of a duration of the noise generated by the activity.

9. The computing system of claim 8, wherein said identifying comprises identifying the input signal as at least one of a button click, a keyboard activity, or a mouse click activity.

10. The computing system of claim 8, wherein said identifying comprises identifying the input signal based on a signal from an input device.

11. The computing system of claim 8, wherein the signal processor is further configured to perform operations including utilizing an operating system to perform said identifying.

12. The computing system of claim 11, wherein the operating system provides an Application Programming Interface (API) allowing the state of an input device to be accessed and provided to the noise suppressor.

13. The computing system of claim 8, wherein the signal processor is configured to perform said identifying in response to a notification of the input signal from an operating system.

14. The computing system of claim 8, wherein the noise suppressor is further configured to perform operations including unmuting the audio signal in response to detecting speech in the audio signal.

15. A computing system comprising:

one or more processors; and a memory device storing software that is configured to be executed by the one or more processors to cause the computing system to perform operations including:

identifying an input signal that results from an activity which generates noise in an audio signal; and suppressing the noise in the audio signal in response to said identifying, said suppressing including:

determining an elapsed time since a most recent detected speech component of the audio signal during which no speech components are detected in the audio signal; and muting the audio signal for a muting time period in response to determining that the elapsed time exceeds a pre-specified speech time period, the pre-specified speech time period being greater than the muting time period and corresponding to a period of time that is to be measured while no speech components are detected in the audio signal, the muting time period having a predetermined duration that is characteristic of a duration of the noise generated by the activity.

16. The system of claim 15, wherein said identifying comprises identifying the activity as at least one of a button clicking activity, a keyboard activity, or a mouse click activity.

17. The system of claim 15, wherein the operations further comprise receiving a notification of the input signal, and wherein said suppressing is performed in response to the notification.

18. The system of claim 15, wherein said suppressing noise in the audio signal further comprises:

analyzing the audio signal to detect components of the audio signal which have characteristics of the generated noise; and suppressing the detected components of the audio signal.

19. The system of claim 15, wherein said audio signal is generated as part of a real time communication event of the computing system.

20. The system of claim 15, wherein the operations further comprise unmuting the audio signal in response to detecting speech in the audio signal.

* * * * *